US010008767B2

(12) United States Patent
Yasin et al.

(10) Patent No.: US 10,008,767 B2
(45) Date of Patent: Jun. 26, 2018

(54) VEHICLE-MOUNT ANTENNA ASSEMBLIES HAVING OUTER COVERS WITH BACK TENSION LATCHING MECHANISMS FOR ACHIEVING ZERO-GAP

(71) Applicant: Laird Technologies, Inc., Earth City, MO (US)

(72) Inventors: Hasan Yasin, Grand Blanc, MI (US); Hela Loudhaief, Holly, MI (US)

(73) Assignee: Laird Technologies, Inc., Earth City, MO (US)

( * ) Notice: Subject to any disclaimer, the term of this patent is extended or adjusted under 35 U.S.C. 154(b) by 77 days.

(21) Appl. No.: 15/157,828

(22) Filed: May 18, 2016

(65) Prior Publication Data

US 2017/0317407 A1 Nov. 2, 2017

Related U.S. Application Data

(60) Provisional application No. 62/329,734, filed on Apr. 29, 2016.

(51) Int. Cl.

| | |
|---|---|
| ***H01Q 1/32*** | (2006.01) |
| ***H01Q 1/12*** | (2006.01) |
| ***H01Q 1/42*** | (2006.01) |
| *H01Q 9/40* | (2006.01) |

(52) U.S. Cl.

CPC ..... *H01Q 1/3275* (2013.01); *H01Q 1/1214* (2013.01); *H01Q 1/42* (2013.01); *H01Q 9/40* (2013.01)

(58) Field of Classification Search

CPC ..... H01Q 1/3275

See application file for complete search history.

(56) References Cited

U.S. PATENT DOCUMENTS

| | | | |
|---|---|---|---|
| 4,090,030 | A | 5/1978 | Lagasse |
| H526 | H | 9/1988 | Miller |
| 5,402,135 | A | 3/1995 | DeMarre et al. |
| 5,515,064 | A | 5/1996 | Bacnik et al. |
| 5,585,809 | A | 12/1996 | Yajima et al. |
| 5,757,327 | A | 5/1998 | Yajima et al. |
| 5,900,840 | A | 5/1999 | Yajima |
| 6,023,245 | A | 2/2000 | Gomez et al. |
| 6,168,855 | B1 | 1/2001 | Cohen et al. |

(Continued)

FOREIGN PATENT DOCUMENTS

| | | |
|---|---|---|
| DE | 1020050446116 | 9/2005 |
| EP | 0862239 A1 | 9/1998 |

(Continued)

*Primary Examiner* — Robert Karacsony

(74) *Attorney, Agent, or Firm* — Harness, Dickey & Pierce, P.L.C.

(57) ABSTRACT

An antenna assembly generally includes an antenna module mountable to a vehicle body wall. The antenna base module may include a base, an inner (e.g., environmental protective cover, etc.) cover coupled to the base, at least one antenna element disposed within an enclosure defined by the inner cover and the base, and one or more latching members. An outer (e.g., cosmetic, styled, and/or aerodynamic, etc.) cover may include one or more snap clip members engageable with the one or more latching members when the outer cover is positioned over the inner cover. The snap clip members may include curved portions and flex points.

20 Claims, 10 Drawing Sheets

(56) References Cited

U.S. PATENT DOCUMENTS

| | | | |
|---|---|---|---|
| 6,377,219 | B2 | 4/2002 | Smith |
| D461,796 | S | 8/2002 | Boyer |
| D465,480 | S | 11/2002 | Boyer |
| 6,486,837 | B2 | 11/2002 | Spiegel et al. |
| 6,486,841 | B1 | 11/2002 | Imahigashi |
| 6,492,960 | B2 | 12/2002 | Sullivan |
| 6,674,412 | B1 | 1/2004 | Schmidt et al. |
| 6,714,171 | B2 | 3/2004 | Haussler et al. |
| 6,762,727 | B2 | 7/2004 | Rochford et al. |
| 6,879,294 | B2 | 4/2005 | Yuanzhu |
| 6,879,301 | B2 | 4/2005 | Kozlovski |
| 6,930,643 | B2 | 8/2005 | Byrne et al. |
| 6,999,033 | B2 | 2/2006 | Kordass et al. |
| 7,002,523 | B2 | 2/2006 | Noro |
| 7,004,666 | B2 | 2/2006 | Kozlovski |
| 7,046,207 | B2 | 5/2006 | Takahashi |
| 7,088,297 | B2 | 8/2006 | Nakano et al. |
| 7,106,272 | B2 | 9/2006 | Noro et al. |
| 7,212,168 | B2 | 5/2007 | Kozlovski |
| 7,429,958 | B2 | 9/2008 | Lindackers et al. |
| 2002/0145567 | A1 | 10/2002 | Spiegel et al. |
| 2003/0197649 | A1 | 10/2003 | Kozlovski |
| 2003/0231136 | A1 | 12/2003 | Du |
| 2004/0150572 | A1 | 8/2004 | Ohno et al. |
| 2004/0174311 | A1 | 9/2004 | Kordass et al. |
| 2004/0217472 | A1 | 11/2004 | Aisenbrey et al. |
| 2005/0225489 | A1 | 10/2005 | Aizawa et al. |
| 2005/0237248 | A1 | 10/2005 | Nakano et al. |
| 2006/0012533 | A1 | 1/2006 | Noro |
| 2006/0077110 | A1 | 4/2006 | Blickle |
| 2006/0097937 | A1 | 5/2006 | Gorai et al. |
| 2006/0110214 | A1 | 5/2006 | Kozlovski |
| 2006/0244667 | A1 | 11/2006 | Thompson et al. |
| 2007/0085361 | A1 | 4/2007 | Hauser |
| 2007/0103374 | A1 | 5/2007 | Lindackers et al. |
| 2007/0171138 | A1 | 7/2007 | Noro |
| 2012/0274519 | A1* | 11/2012 | Chakam ..... H01Q 1/3275 343/702 |
| 2017/0104264 | A1* | 4/2017 | Kobayashi ..... H01Q 1/42 |

FOREIGN PATENT DOCUMENTS

| | | | |
|---|---|---|---|
| EP | 1411585 | A1 | 4/2004 |
| JP | 200520660 | | 1/2005 |

* cited by examiner

VEHICLE-MOUNT ANTENNA ASSEMBLIES HAVING OUTER COVERS WITH BACK TENSION LATCHING MECHANISMS FOR ACHIEVING ZERO-GAP

CROSS-REFERENCE TO RELATED APPLICATION

This application claims priority to and the benefit of U.S. Provisional Patent Application No. 62/329,734 filed Apr. 29, 2016. The entire disclosure of the above application is incorporated herein by reference.

FIELD

The present disclosure generally relates to antenna assemblies mountable to mobile platforms, such as automobile or vehicle roofs, hoods, or trunk lids.

BACKGROUND

This section provides background information related to the present disclosure which is not necessarily prior art.

Various antenna types are used in the automotive industry, including aerial AM/FM antennas, patch antennas, etc. Antennas for automotive use are commonly positioned on the vehicle's roof, hood, or trunk lid to help ensure that the antenna has an unobstructed view overhead or towards the zenith.

By way of example, antenna assemblies typically include a protective cover for sealing and encasing the electrical components on a printed circuit board. The printed circuit board, in turn, is commonly fixed with screws to a die cast chassis or body of the antenna assembly. The body and cover are then installed, for example, to the vehicle roof. A rubber seal may be used to fill the gap or space between the protective cover and the vehicle roof.

At the assembly plant in which antenna assemblies are installed to the vehicles, it is common for the different styles and colors of the protective covers to be kept together in one place in order to install those covers at the same station. To achieve a zero-gap "look" between the antenna's cover and the roof of the vehicle, a unique antenna cover has to be designed to fit each specific vehicle roof curvature. This results in logistical issues as well as issues with installation of the correct antenna to the intended vehicle.

DRAWINGS

The drawings described herein are for illustrative purposes only of selected embodiments and not all possible implementations, and are not intended to limit the scope of the present disclosure.

Figure 1:
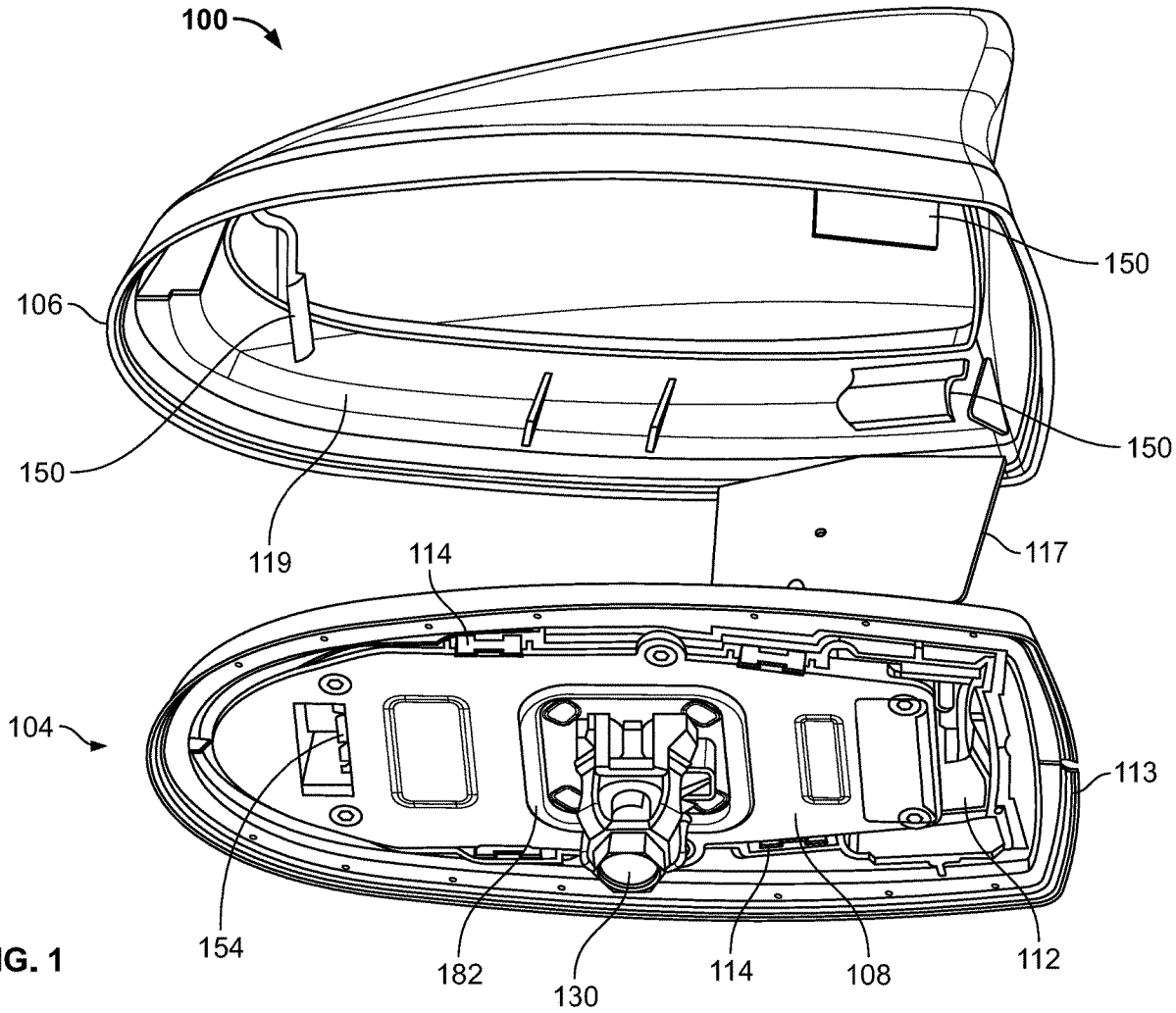
FIGS. 1 and 2 are respective lower and upper exploded perspective views of an antenna assembly having latching mechanisms for achieving zero-gap according to exemplary embodiments.
Figure 2:
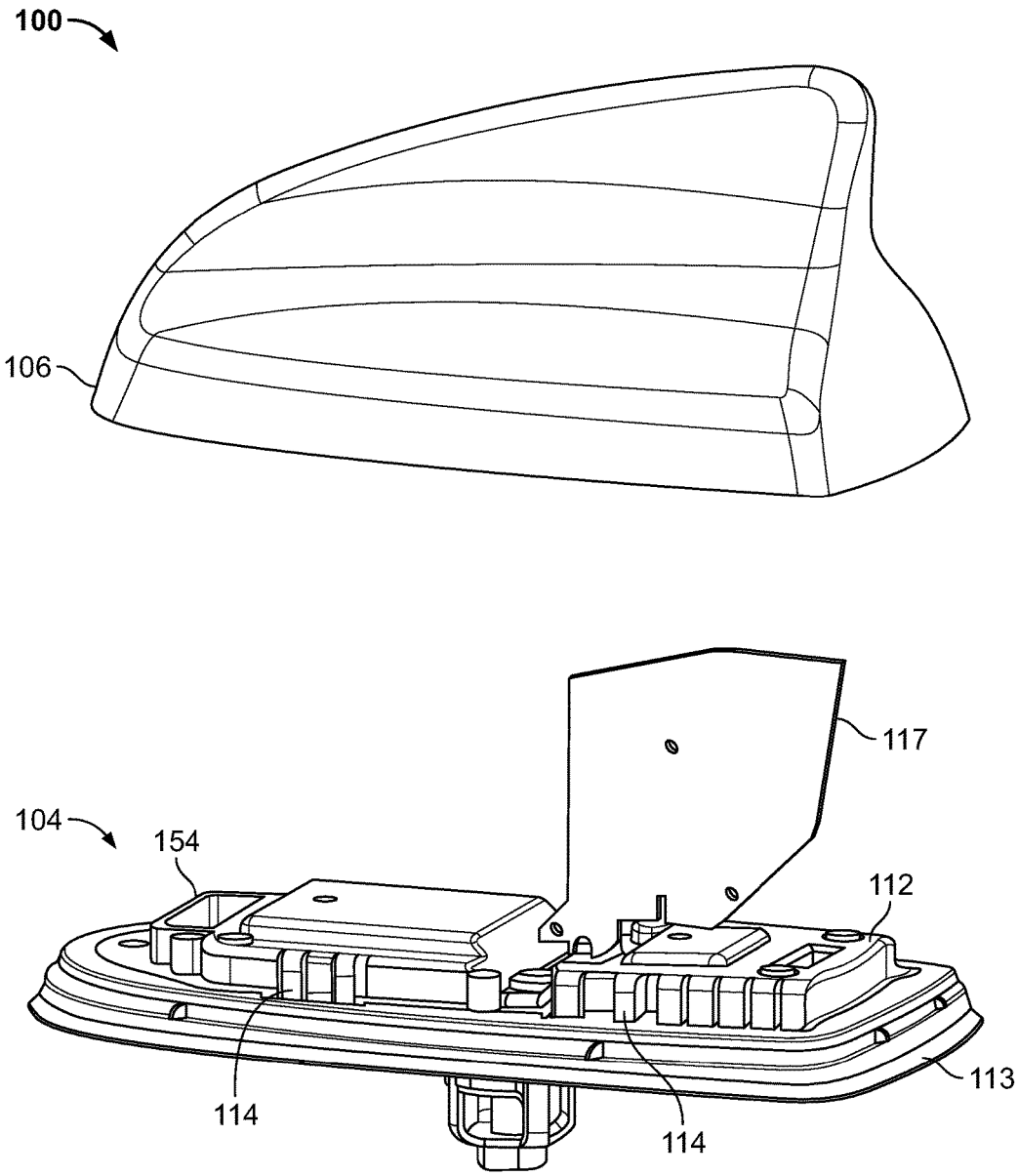
Figure 7C:
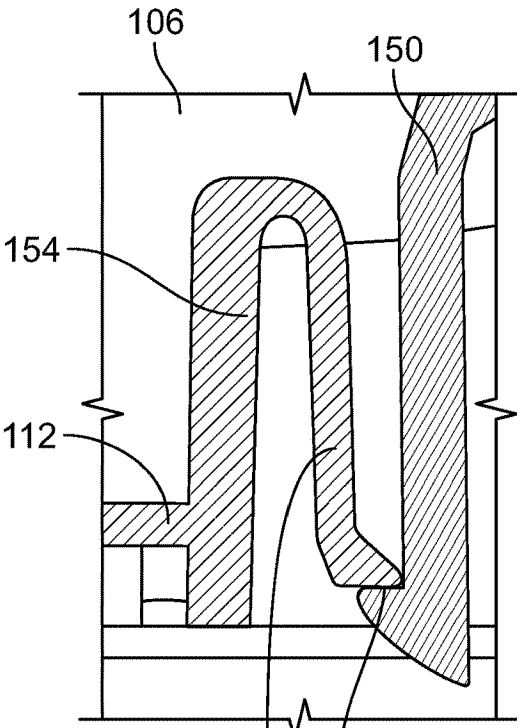
Figure 7B:
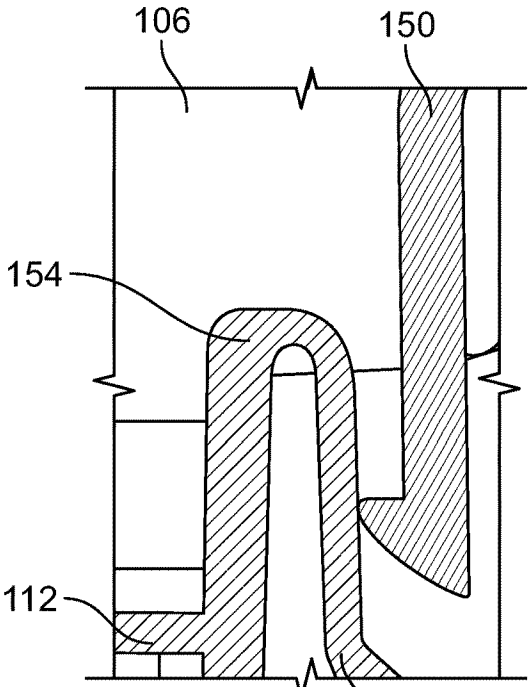
Figure 7A:
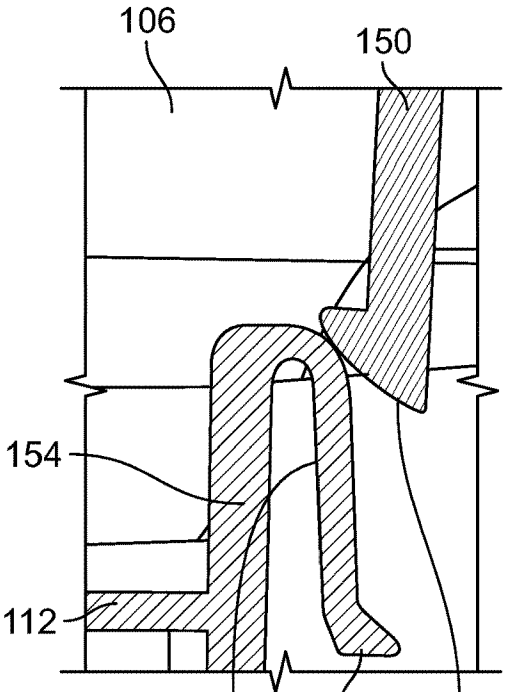

FIGS. 7A, 7B, and 7C are views of one of the latching mechanisms of the antenna assembly shown in FIGS. 1 and 2 and illustrating various stages of an exemplary installation process for securing the outer cover to the inner cover of the antenna base module; and FIGS. 8A through 8D illustrate exemplary components at various stages of an installation process for mounting the antenna assembly shown in FIGS. 1 and 2 to a vehicle body wall according to an exemplary embodiment.

Corresponding reference numerals indicate corresponding parts throughout the several views of the drawings.

DETAILED DESCRIPTION

Example embodiments will now be described more fully with reference to the accompanying drawings.

Disclosed herein are exemplary embodiments that include an outer cover or housing (e.g., styled, cosmetic, aerodynamic, and/or shark-fin style cover, etc.) configured to be snapped or latched onto an inner cover or radome (e.g., an environmental protective cover, etc.) or other component of an antenna base module before or after the antenna base module is installed (e.g., nipped, etc.) to a vehicle body wall. In exemplary embodiments, a substantially zero-gap is achieved between the antenna assembly and a vehicle body wall (e.g., roof, trunk lid, hood, etc.) through back tension hook and latch mechanisms as disclosed herein. For example, a substantially zero-gap may be achieved between the bottom edge of an outer cover and a vehicle body wall (e.g., roof, trunk lid, hood, etc.) through back tension hook and latch mechanisms in some exemplary embodiments. In other exemplary embodiments, a portion of a sealing member or dust seal (e.g., an elastomeric sealing member, a rubber sealing member, a thermoplastic elastomer sealing member, etc.) may be disposed along and between the bottom edge of the outer cover and the vehicle body wall. In such other exemplary embodiments, a substantially zero-gap may be achieved between the bottom edge of the outer cover and the portion of the dust seal and between the vehicle body wall and the portion of the dust seal through the back tension hook and latch mechanisms, which help to compress the portion of the dust seal between the bottom edge of the outer cover and the vehicle body wall.

Aspects of the present disclosure relate to antenna assemblies having outer covers that may be engaged to antenna assemblies (e.g., to an antenna base or chassis, protective cover, other component of the antenna assembly, etc.) by way of back tension latching mechanisms. In various embodiments, back tension latching mechanisms allow an outer cover to be engaged with an antenna base module (e.g., an environmental protective cover of the antenna base module, etc.) and the vehicle body wall such that the latching mechanisms exert back tension or spring force in order to achieve substantially zero-gap with little to no space between the bottom edge of the outer cover and the vehicle body wall. Antenna components are not always precisely manufactured due to tolerances and variances. Even so, exemplary embodiments disclosed herein provide outer covers having back tension from curved snap clip members, for example, to accommodate for the tolerances and still achieve substantially zero-gap with a relatively perfect fit to a vehicle body wall.

In some exemplary embodiments, the antenna assembly is configured with one or more latching mechanisms that resist regression once a snap clip member and corresponding latching member are engaged. The mechanism locks the outer cover in place using back tension to enable a tight fit between the outer cover and the antenna base and/or between the vehicle body wall and the outer cover or dust seal. The back tension mechanisms include curved snap clip members which, when engaged with latching members, exert back tension or spring force that holds the spring clip members and latching members securely together. This ensures that the outer cover does not adjust upwardly too far. The back tension is provided in a direction substantially parallel to the latching mechanism, such that the snap clip member pulls tightly against the latching member of the mechanism. This back tension inhibits further flexing of the snap clip members and gapping between the vehicle body wall and the lower edge of the outer cover while under external loads.

In various exemplary embodiments, an antenna assembly generally includes a fully functional, environmentally sealed antenna base module and an outer cover that is styled for cosmetic purposes. For example, the outer cover may have a shark fin shape, styling or configuration for better appearance. In which case, the antenna assembly may be referred to as a shark fin antenna. When the antenna assembly is installed into a mounting opening or cutout of a vehicle body wall, the outer cover or dust seal conforms to the vehicle body wall surrounding the opening with substantially zero-gap therebetween. This zero-gap is accomplished by way of the compliant or resilient latching/snapping mechanism, including a curve at a point of flex of the mechanism that provides back tension causing the mechanism to remain tightly engaged. In these embodiments, the antenna base module is designed so as to fit on different roof curvatures. The interface between the antenna base module and the outer cover allows for assembling different covers (e.g., with different styles, colors, curvatures, etc.) to one common antenna base module. Advantageously, this may allow multiple antenna styles and colors that may be fitted to one common base module, which, in turn, should help reduce installation errors and logistical issues in the assembly plants.

Accordingly, aspects of the present disclosure may allow for use of a common antenna base module across a wide range of automobiles despite the different roof curvatures and contours of the automobiles. With the back tension latching mechanisms disclosed herein, the outer cover is capable of tightly engaging with the antenna base module based on the back tension provided by the curved latching mechanism, to thereby ensure a relatively perfect fit or interfacing with variously contoured vehicle roofs. By allowing for the use of a single antenna base module design across different vehicle types, aspects of the present disclosure allow for common parts and tooling, which may, in turn, allow for reduced costs.

Figure 3:
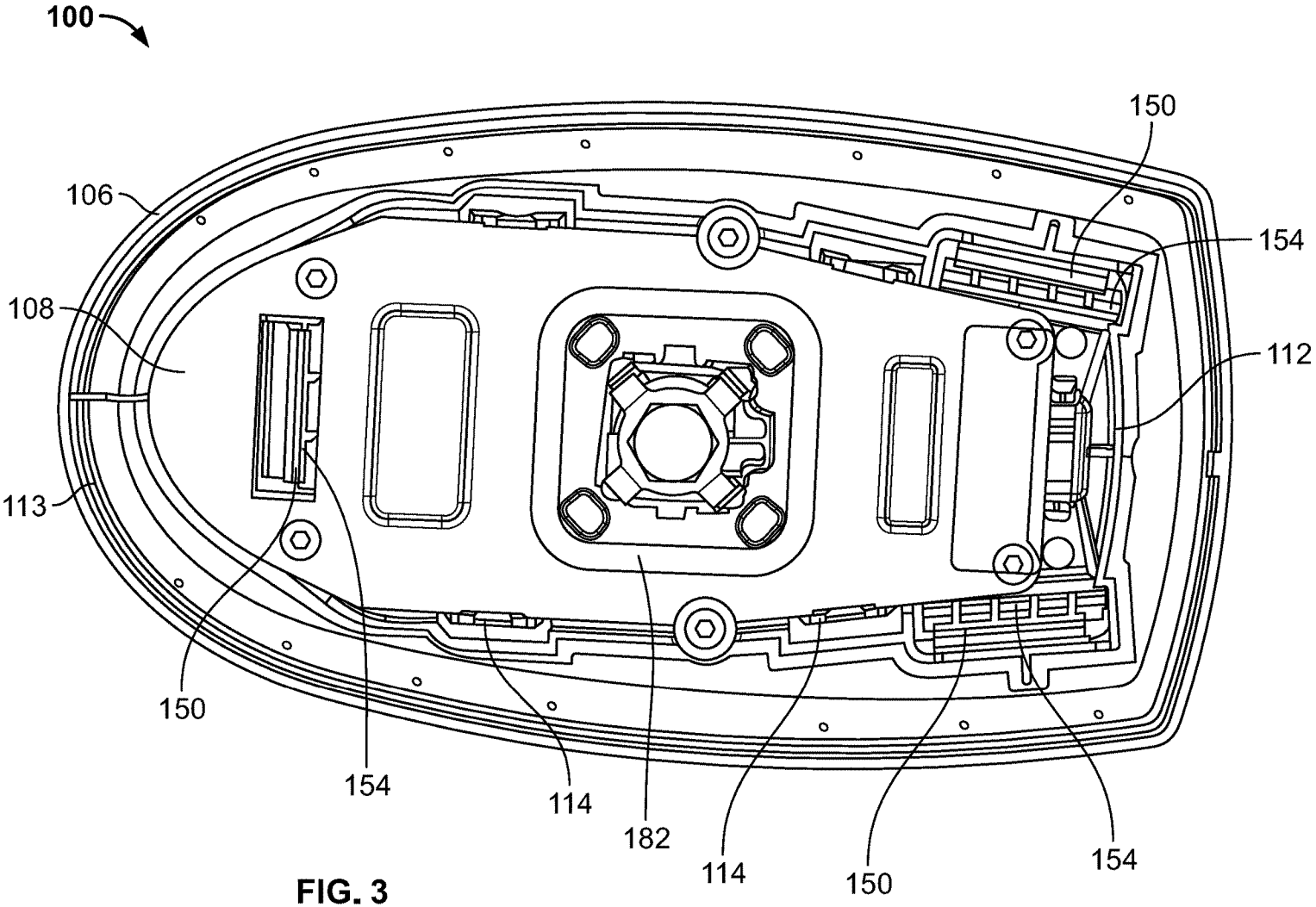
FIG. 3 is a bottom view of the antenna assembly shown in FIGS. 1 and 2 after the outer cover has been positioned over and secured to the inner cover of the antenna base module.

With reference to FIGS. 1, 2, and 3, there is shown an exemplary antenna assembly 100 embodying one or more aspects of the present disclosure. As shown, the antenna assembly 100 includes a fully-functional, environmentally sealed antenna base module 104 that is mountable to a vehicle body wall, such as a vehicle roof, trunk lid, or hood. An outer, concave-shaped, snap-on cosmetic cover 106 (broadly, an outer cover) is securable to the antenna base module 104 for encasing the base module 104 and providing an aesthetically pleasing appearance to the antenna assembly 100 with a substantially zero-gap fit of the antenna assembly 100 with the vehicle body wall as disclosed herein. In this example, the outer cover 106 has a shark fin shape, styling, or configuration, and the antenna assembly 100 may also be referred to as a shark fin antenna assembly 100. Alternatively, the outer cover 106 may have a different shape, styling, or configuration.

The antenna base module 104 includes a base or chassis 108 and a protective environmental cover (or radome) 112 (broadly, an inner cover) attached (e.g., latched, snap-clipped, etc.) to the base 108. A seal or sealing member 113 is disposed around a lower portion of the protective inner cover 112. The seal 113 preferably inhibits the ingress of dust into the first interior enclosure 115 collectively defined by and generally between the protective cover 112 and the base 108. Accordingly, the seal 113 may also be referred to herein as a dust seal.

Figure 4:
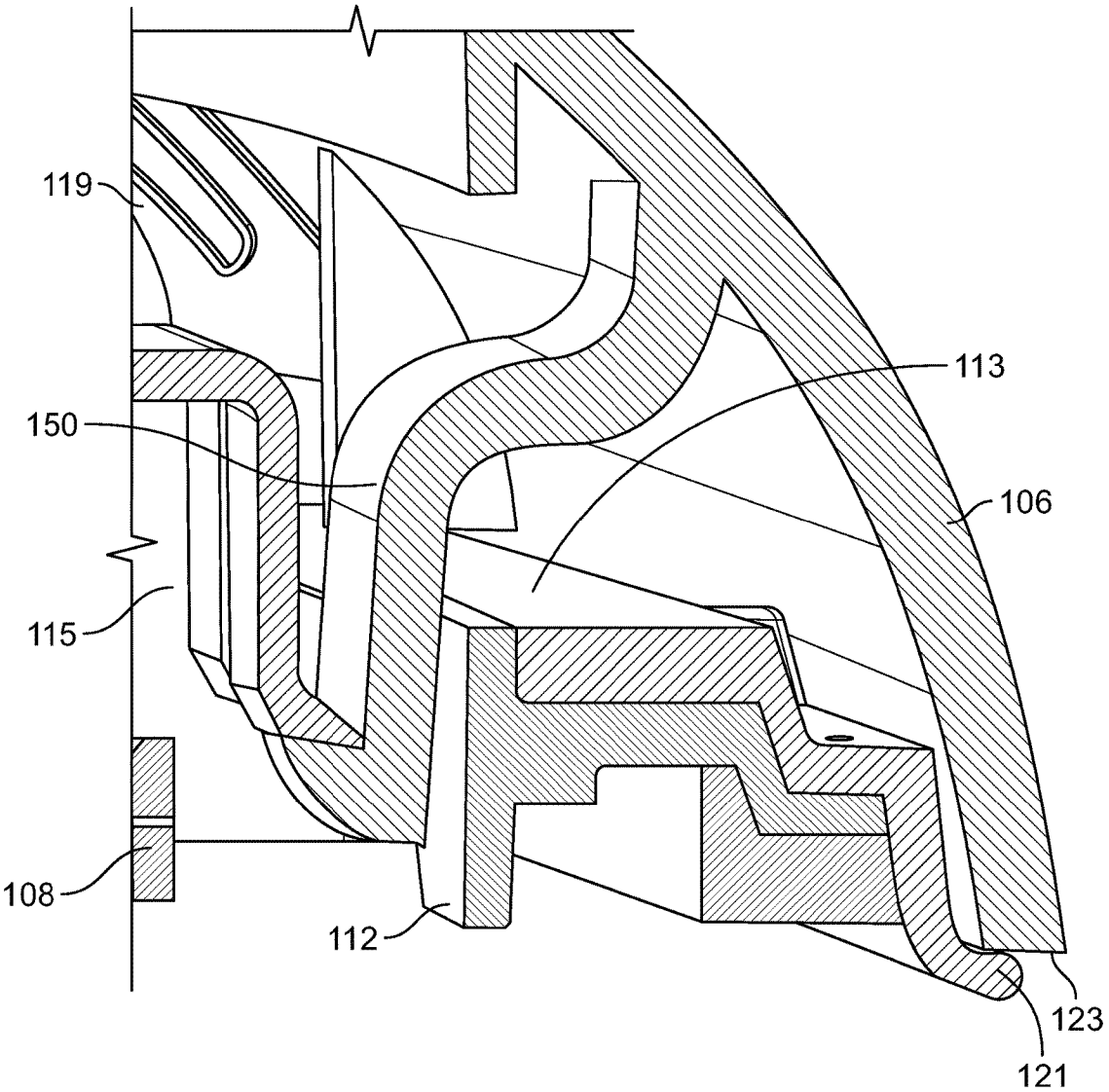
FIG. 4 is a perspective view of a portion of the antenna assembly shown in FIGS. 1 and 2 and illustrating one of the latching mechanisms of the antenna assembly being used to secure the outer cover to the inner cover of the antenna base module.
Figure 5:
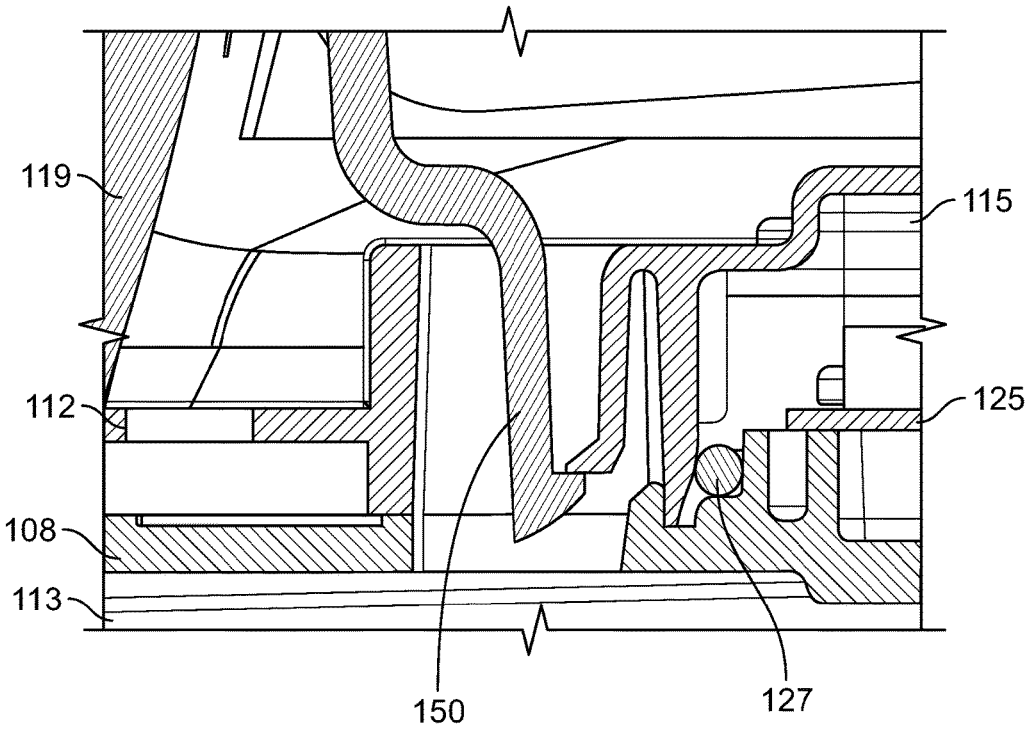
FIG. 5 is another view of a portion of the antenna assembly shown in FIGS. 1 and 2 and illustrating one of the latching mechanisms of the antenna assembly being used to secure the outer cover to the inner cover of the antenna base module.

As shown in FIG. 5, the protective cover 112 may be seated or supported on the antenna base 108. The seal 113 may be seated or supported on the protective cover 112 as shown in FIG. 4. In alternative embodiments, the antenna assembly 100 may include a protective cover 112 that overlaps the base 108 and substantially encases the base 108 and/or the antenna assembly 100 may not include the dust seal 113.

The antenna base module 104 also includes at least one antenna disposed within the first interior enclosure 115 (FIGS. 4 and 5) collectively defined by and generally between the protective cover 112 and the base 108. For example, the antenna assembly 100 may include one or more patch antennas within the first interior enclosure 115. The patch antennas may be coupled to and/or supported on a printed circuit board 125 (FIG. 5), which, in turn is coupled to and/or supported by the base 108. The patch antennas may be configured to be operable for receiving satellite signals. In an exemplary embodiment, the antenna assembly 100 includes a first patch antenna configured to be operable for receiving GNSS signals (e.g., GPS and/or GLONASS signals, GPS and/or Beidou signals, etc.) and a second patch antenna configured to be operable for receiving SDARS signals (e.g., Sirius XM, Telematics Control Unit (TCU), etc.).

In this exemplary embodiment, the antenna assembly 100 includes an antenna 117 external to the inner cover 112. The antenna 117 is disposed within a second interior enclosure 119 collectively defined by and generally between the outer cover 106 and the inner cover 112. By way of example, the antenna 117 may comprise a cellular antenna (e.g., an inverted F antenna (IFA), a monopole antenna, an inverted L antenna (ILA), a planar inverted F antenna (PIFA), a stamped mast antenna, other mast antenna, etc.) configured to be operable over one or more cellular frequencies (e.g., Long Term Evolution (LTE), etc.). In alternative embodiments, the antenna assembly 100 may only include one or more antennas within the first interior enclosure 115 and thus not include any antennas (e.g., antenna 117, etc.) external to the inner cover 112.

The first interior enclosure 115 is substantially sealed by the base 108, protective cover 112, dust seal 113, and a sealing member or seal 127 (FIG. 5). This sealing preferably inhibits the ingress of contaminants (e.g., dust, moisture, etc.) into the first interior enclosure 115 in which at least one antenna element may be disposed. The protective cover 112 may be formed from a wide range of materials, such as polymers, urethanes, plastic materials (e.g., polycarbonate blends, Polycarbonate-Acrylnitril-Butadi en-Styrol-Copolymer (PC/AB S) blend, etc.), glass-reinforced plastic materials, synthetic resin materials, thermoplastic materials (e.g., GE Plastics Geloy® XP4034 Resin, etc.), among other suitable materials.

In some embodiments, the antenna base 108 may be die cast from zinc. Alternatively, the antenna base 108 may instead be formed by a different process other than die casting and/or be formed from a different material or composite of materials.

The dust seal 113 may be formed from a wide range of materials, such as elastomeric materials, thermoplastic elastomers, rubber, etc. As show in FIG. 4, the dust seal 113 includes a portion 121 disposed along a bottom edge 123 of the outer cover 106. In the final installed position of the antenna assembly 100 to a vehicle body wall, the portion 121 of the dust seal 113 directly contacts and conforms against the vehicle body wall without any gap or with substantially zero gap therebetween. The portion 121 of the dust seal 113 may also be compressed between the bottom edge 123 of the outer cover 106 and the vehicle body wall such that the portion 121 of the dust seal 113 widens and extends along an entire width of the bottom edge 123 of the outer cover 106. In alternative embodiments, the antenna assembly 100 may be configured such that the bottom edge 123 of the outer cover 106 directly contacts and conforms against the vehicle body wall without any gap or with substantially zero gap therebetween in the final installed position of the antenna assembly 100 to the vehicle body wall.

A description will be provided of one exemplary method by which a protective cover may be attached to the antenna base module. This description, however, is provided for purposes of illustration only and not for limitation.

With reference to FIGS. 1 and 3, the inner protective cover 112 has snap-tabs 114 for engagement with corresponding beveled snap-tab receiving portions associated with the antenna base 108 to help secure the inner protective cover 112 to the base 108. The snap-tab receiving portions are integrally located about a perimeter of the antenna base 108. The snap-tab receiving portions are designed to engage the flexible snap-tabs 114 of the protective cover 112 to fasten and matingly secure the protective cover 112 to the base 108. Essentially, as the protective cover 112 is positioned over the base 108, the snap-tabs 114 momentarily flex outwardly and then return back inwardly in the reverse direction after they have cleared the snap-tab receiving portions. In the illustrated embodiment, the protective cover 112 includes a pair of snap-tabs 114 on each longitudinal side of the protective cover 112. The base 108 includes two corresponding snap-tab receiving portions on each of the two longitudinal sides of the base 108. Alternatively, more or less snap-tabs 114 and receiving portions and/or different arrangements of the same may be used in other embodiments. For example, the protective cover 112 may also or alternatively have snap-tabs 114 located at or adjacent the front and back longitudinal ends of the protective cover 112. In addition, the arrangement of the snap-tabs 114 and snap-tab receiving portions may be reversed. In which case, the base 108 may include snap-tabs with the protective cover 112 including the snap-tab receiving portions. Alternatively or additionally, mechanical fasteners, such as screws, among other fastening devices, etc., may also be used for securing the protective cover 112 to the base 108. Alternative embodiments may include other means for attaching a protective cover to a base, such as by ultrasonic welding, interference or snap fit, solvent welding, heat staking, latching, bayonet connections, hook connections, integrated fastening features, mechanical fasteners, combinations thereof, etc.

Still further embodiments may not include an inner protective cover separate from the outer cosmetic cover. For example, another exemplary embodiment of the antenna assembly 100 generally includes a single cover which is attached to the antenna base 108 by back tension latching mechanisms that facilitates a substantially zero-gap fit of the antenna assembly 100 with a vehicle body wall. This particular embodiment may also include at least one sealing member between the cover and the vehicle body wall for sealing the interface therebetween.

As shown in FIG. 1, the cosmetic cover 106 includes three snap clip members 150. One snap clip member 150 is located adjacent the front of the cosmetic cover 106, while the other two snap clip members 150 are located along opposing sides of the cosmetic cover 106 adjacent the back of the cosmetic cover 106. Each snap clip member 150 extends generally downward from inside the cover 106. The snap clip members 150 are preferably resiliently flexible.

Figure 6A:
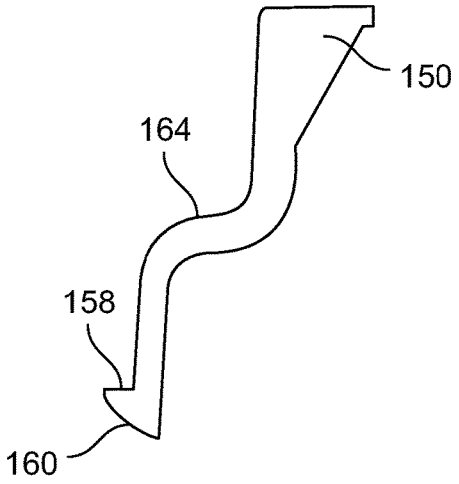
FIGS. 6A and 6B are side views of one of the snap clip members of the outer cover shown in FIGS. 1, 4, and 5.

As shown in FIG. 6A, each snap clip member 150 also preferably includes an upper abutment surface 158 and a lower cam surface 160. The end portion that includes the upper abutment surface 158 and lower cam surface 160 may also be generally referred to as a hook. The resilient or compliant nature of the snap clip members 150 allows them to resiliently bend, flex, deform, or otherwise move relative to the cosmetic cover 106 as described in more detail herein.

Figure 6B:
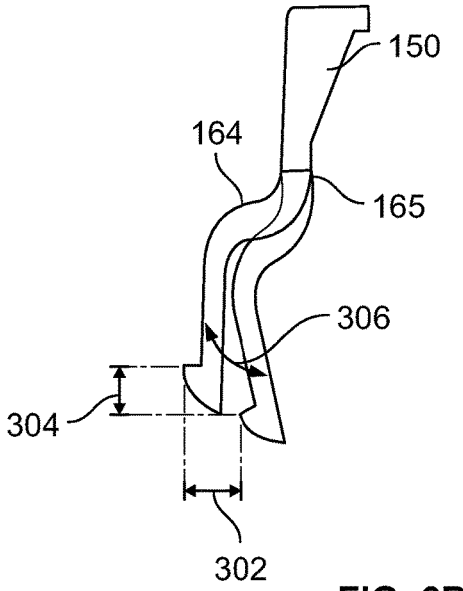

As illustrated in FIGS. 6A and 6B, the snap clip member 150 includes a curved portion 164 above the upper abutment surface 158. The curved portion 164 includes a flex point 165 at which the snap clip member 150 flexes during assembly. The combination of the curved portion 164 and flex point 165 (FIG. 6B) causes the resilient snap clip member 150 to travel during assembly in such a way that back tension is provided in a substantially opposing direction against a latching member when assembled.

FIG. 6B illustrates two states of the snap clip member 150 and the travel between them. In the "assembled" or "relaxed" state, the snap clip member 150 is shown in a similar shape as illustrated in FIG. 6A. But in the "during assembly" or "deformed" state, the snap clip member 150 has flexed at the flex point 165 resulting in travel of the end portion of the snap clip member 150, which includes the upper abutment surface 158 and the lower cam surface 160. The travel of the snap clip member 150 occurs in both a horizontal direction component 302 and vertical direction component 304. Because the snap clip member 150 flexes around the flex point 165, the motion of the snap clip member 150 may also be described as traveling in an arc 306 around the flex point 165. As embodied in FIGS. 6A and 6B, the snap clip member 150 may travel a horizontal distance 302 (e.g., about 0.7975 millimeters (mm), about 1 mm, etc.) at around the level of the upper abutment surface 158 from the relaxed state to the deformed state during assembly. The snap clip member 150 may further be described as traveling in an arc (e.g., about 4.4728 degrees, etc.) generally around the flex point 165. The dimensions provided in this paragraph (and all other dimensions disclosed herein) are for purposes of illustration only and not for purposes of limitation.

As shown by a comparison of FIGS. 7A and 7B, the end portion of the snap clip member 150 travels downwardly and to the right during the assembly process. But after the snap clip member 150 clears the latching surface 169 of the latching member 162, the end portion or hook of the snap clip member 150 will then travel upwardly and to the left such that the abutment surface 158 is latched with or abutted against the latching surface 169 as shown in FIG. 7C. The upward travel of the snap clip member 150 after the end portion clears the latching surface 169 will pull the outer cover 106 downward towards the vehicle roof, etc.

In the illustrated embodiment, the snap clip members 150 are formed integral with the cosmetic cover 106. In other embodiments, the snap clip members 150 may be formed separate from the cover. In which case, the snap clip members 150 would be separately attached to the cover 106, for example, by welding, adhesives, etc.

The protective cover 112 includes three latches 154 that are configured for engaging the snap clip members 150. The latches 154 and snap clip members 150 may be configured for forming a resiliently compliant connection of the cosmetic cover 106 to the base module 104. One of the latches 154 is located adjacent the front of the protective cover 112, while the other two latches 154 are located along opposing sides of the protective cover 112 adjacent the back of the protective cover 112.

As shown in FIGS. 7A through 7C, each latch 154 includes a latching member 162. In this exemplary embodiment, the latches 154 may be configured such that the latching members 162 do not resiliently bend, flex, deform, or otherwise move relative to the protective cover 112 when the snap clip members 150 are being engaged with the latching members 162. Alternatively, the latches 154 may be configured such that the latching members 162 resiliently bend, flex, deform, or otherwise move relative to the protective cover 112 when the snap clip members 150 are being engaged with the latching members 162.

In this exemplary embodiment, the latches 154 are formed integral with the protective cover 112. In other embodiments, the latches 154 may each be formed separate from the protective cover 112. In such alternative embodiments, the latches may be separately attached to the protective cover, for example, by welding, adhesives, etc. Other embodiments of the antenna assembly 100 may have outer and inner covers that include more or less than three (e.g., two, four, etc.) snap clip member 150 and latches 154, respectively.

In still other embodiments, the latches 154 may be formed integral with or be attached to another antenna component, such as the antenna base, etc. In those embodiments that include only an outer cover 106 without the inner cover 112, latches 154 may be integrally formed in or attached to the base 108 or other structural components of the antenna base module 104.

With reference now to FIGS. 7A through 8D, an exemplary process will be described for initially connecting the outer cosmetic cover 106 to the antenna base module 104 (an initial connected position), and then connecting the interconnected cosmetic cover 106 and antenna base module 104 to a roof R of a vehicle (a final installed position). In other exemplary processes, the antenna base module 104 may first be connected to the vehicle roof R (or other vehicle body wall), and then the cosmetic cover 106 may be connected to the base module 104 in the final installed position.

The cosmetic cover 106 is positioned generally over the protective cover 112 so that snap clip members 150 of the cover 106 align with the latches 154 of the cover 112. The cosmetic cover 106 is then pressed onto the protective cover 112 so that each snap clip member 150 moves into its corresponding latch 154. For convenience only, operation of only one snap clip member 150 and latch 154 will be further described with it being understood that operation of the other snap clip members and latches will be substantially the same. As the snap clip member 150 moves downwardly towards the latch 154, the snap clip member 150 engages the latching member 162 (FIG. 7A). With continued downward movement of the snap clip member 150, the cam surface 160 of the snap clip member 150 contacts the latching member 162. This contact causes the snap clip member 150 to deform by flexing at flex point 165 (FIGS. 7B and 7C) while the latching member 162 remains stationary without flexing or deforming. In other exemplary embodiment, the contact may urge or cause the latching member 162 to flex, deform or otherwise move away from the snap clip member 150. In such alternative embodiments, the latching member 162 may be resilient such that after being moved away from the snap clip member 150, the resilient latching member 162 would move back to or near to its original, un-flexed position with its latching surface 169 generally aligned with and above the snap clip's abutment surface 158.

As seen by comparing FIGS. 7B and 7C, the snap clip member 150 (after clearing the tip of the latching member 162) will tend to snap or move back to its original, un-flexed position. The snap clip member 150 may not move completely back to its un-flexed position due to the engagement of the latching member's latching surface 169 and the snap clip member's abutment surface 158. Because the snap clip 150 flexes at the flex point 165, the snap clip member 150 may exert a back tension or spring force against the latching member's latching surface 169 through the abutment surface 158 in a substantially opposing direction to the latching member 162. At this point, the cosmetic cover 106 is retained over the protective cover 112 and antenna base module 104, and removal of the cosmetic cover 106 from off the protective cover 112 will be resisted by the latching member's latching surface 169 engaging the snap clip's abutment surface 158, including the back tension between the two. The relative angle between the snap clip member 150 and latching member 162 may be about 45 degrees.

In alternative embodiments in which the latching member 162 is resiliently flexible, deformable, or otherwise movable, the snap clip member 150 may be sized lengthwise to move a sufficient distance past the latching member 162 when the cosmetic cover 106 is being initially provided on and connected to the base module 104. This may provide space or room for the latching member 162 to return to or near to its original, un-flexed position without interference from the snap clip member 150. "Over travel" distance of the snap clip member 150 may be considered generally as the maximum distance between the latching member's latching surface 169 and the snap clip's abutment surface 158 when the cosmetic cover 106 is initially provided onto and connected to the antenna base module 104. The snap clip's abutment surface 158 is caused to move sufficiently under the latching member's latching surface 169 in order for the latching member 162 and the snap clip member 150 to return to or near to their original, un-flexed positions.

In the illustrated embodiment, the curved portion 164 of the snap clip member 150 and the substantially opposing back tension or spring force generated thereby allows the latching mechanism to exhibit no over travel or essentially zero over travel distance when the snap clip member 150 is flexed/under tension. In other embodiments, the over travel may be about 0.4 millimeters or more. In still further embodiments, the over travel may range from greater than 0 millimeters to about 2 millimeters or less. The over travel distance may depend, for example, on the particular geometry of the snap clip member 150 and latch 154. The dimensions provided in this paragraph (as are all dimensions disclosed herein) are for purposes of illustration only and not for purposes of limitation.

With initial connection of the cosmetic cover 106 to the antenna base module 104 now described, a description of the final connection/installation of the antenna assembly 100 to a vehicle will now be provided according to exemplary embodiments. With reference to FIGS. 8A through 8D, the antenna assembly 100 (including the cosmetic cover 106) is positioned relative to a mounting opening in a vehicle roof R. The installation process may also include drawing the cosmetic cover 106 and antenna base module 104 into tight contact with the vehicle roof R so that the portion 121 of the dust seal 113 (FIG. 4) conforms again, abuts, and applies pressure against the roof R with substantially no gaps between the dust seal portion 121 and the roof R and between the dust seal portion 121 and the outer cover 106, thereby providing a substantially zero-gap fit of the antenna assembly 100 to the roof R.

Before positioning the antenna assembly 100 relative to the mounting opening, a bolt 130 may be positioned through openings in first and second retaining components 126, 128 and threadingly engaged to a correspondingly threaded portion associated with a mounting structure of the antenna base 108. By way of example, the threaded portion may comprise a threaded insert or threaded member that is separately attached or coupled to the antenna base 108. Or, for example, the threaded portion may be integrally defined or formed by the antenna base 108. When the bolt 130 is thus threaded, it captures the second retaining component 128 and first retaining component 126 against the mounting structure. The legs 134 of the first retaining component 126 align with cam surfaces of the second retaining component 128, and the end portions 144 of the legs 134 generally face the antenna base 108. This facilitates positioning the antenna assembly 100 relative to the mounting opening in the vehicle roof R since the first and second retaining components 126, 128 and bolt 130 will not fall or drop out as the antenna assembly 100 is being positioned and connected to the roof R. Capturing the components in this exemplary manner also allows the installer (from outside the vehicle) to easily position the antenna assembly 100 as a single unit (including the cosmetic cover 106 and antenna base module 104) relative to the vehicle mounting opening. Advantageously, this allows for a reduction in the number of operations or steps needed for antenna installation as compared to those installation methods in which there is no such capturing of the fastener and retaining components.

Next, the antenna assembly 100 is positioned (from outside the vehicle) as a single unit relative to the mounting opening in the vehicle roof R. As the antenna assembly 100 is moved downwardly relative to the roof opening, the resilient positioning clips 132 of the second retaining component 128 may be deformed or distorted inward temporarily to fit through the mounting opening, but will expand outwardly upon passing through the opening completely due to their resiliency or elasticity. The cam surfaces of the second retaining component 128 and the legs 134 of the first retaining component 126 are configured (e.g., dimensionally sized, shaped, etc.) such that they will not catch the inside of the roof mounting opening as they are inserted through the opening. The particular configurations for the retaining legs 134 and cam surfaces may depend, for example, on the particular location at which the antenna assembly 100 is to be used, space considerations, etc. In addition, each retaining leg 134 does not necessarily have the same configuration (e.g., size, shape, etc.) in other embodiments. Alternative embodiments may include more or less retaining legs 134 and/or retaining legs having different configurations (e.g., shapes, dimensions, etc.) than what is shows in the figures. For example, other embodiments include retaining legs 134 with L-shaped or U-shaped feet or end portions.

Figure 8A:
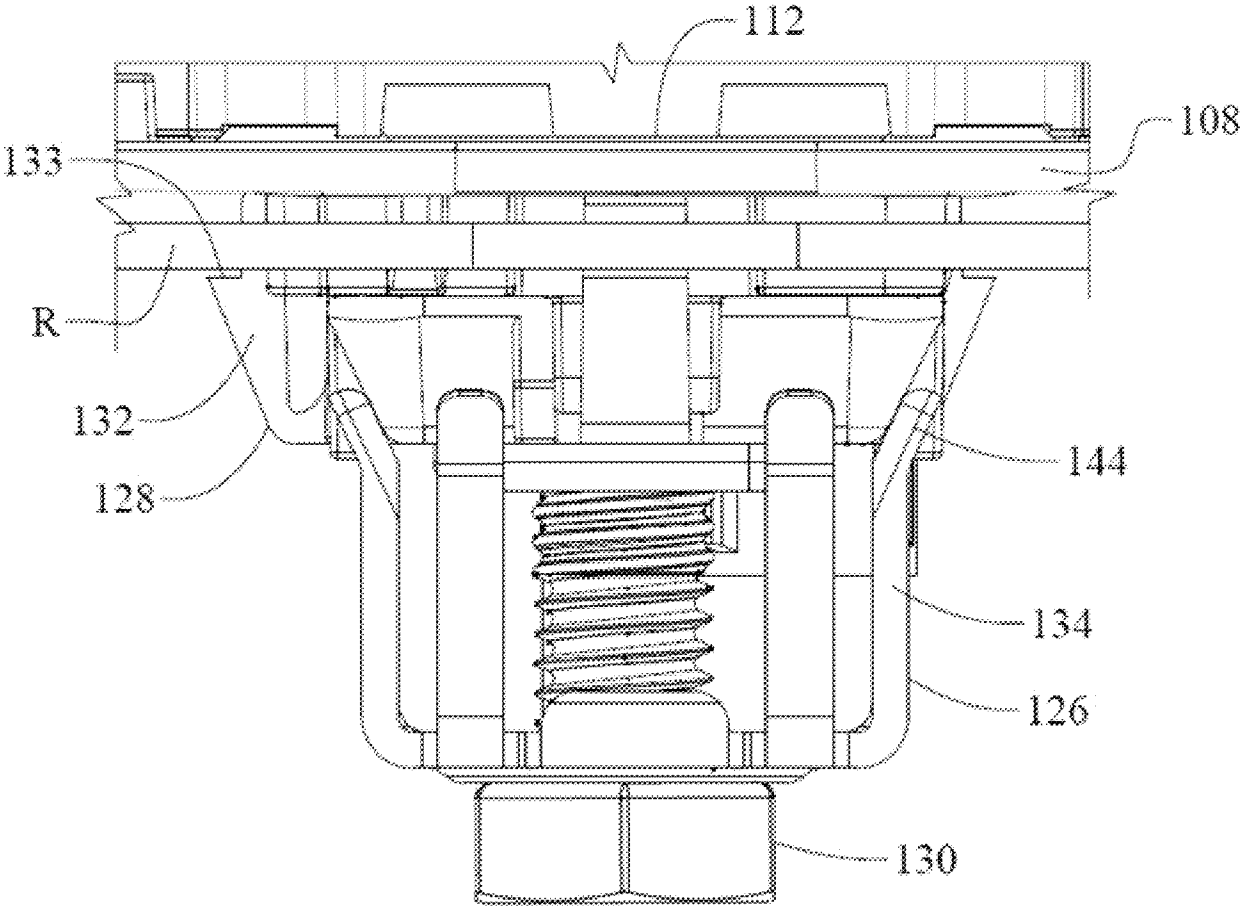
Figure 8B:
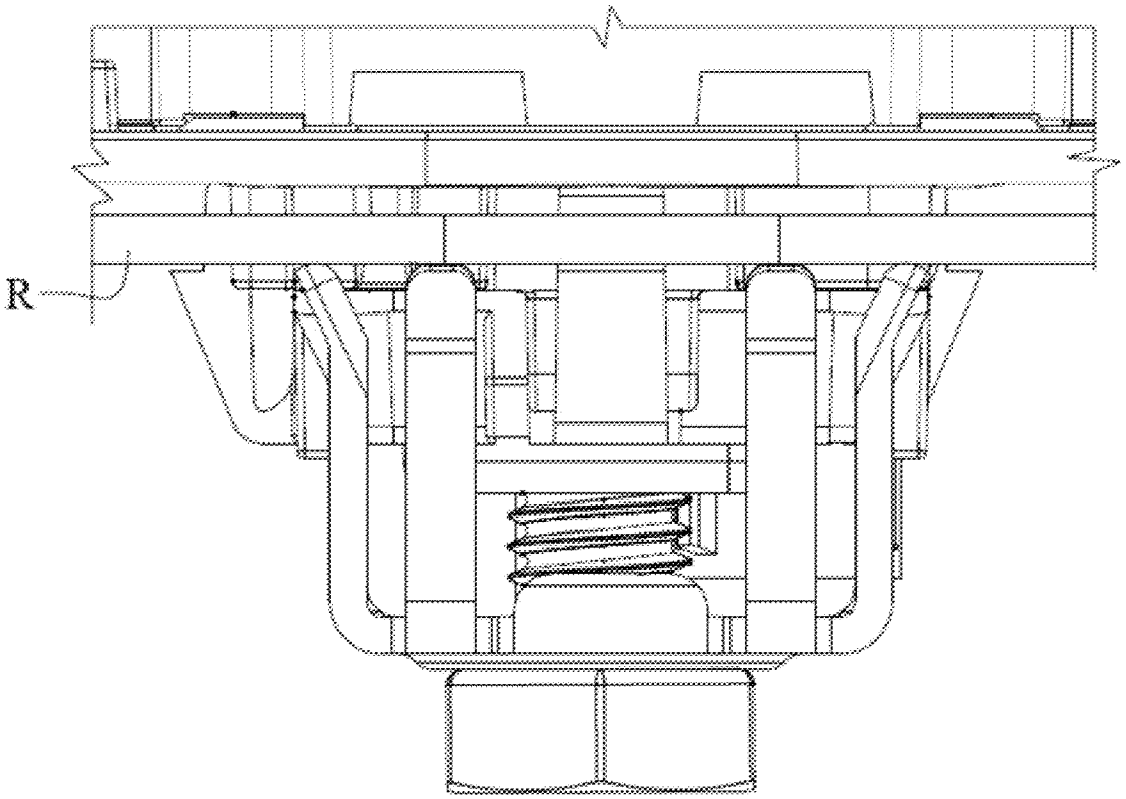
Figure 8C:
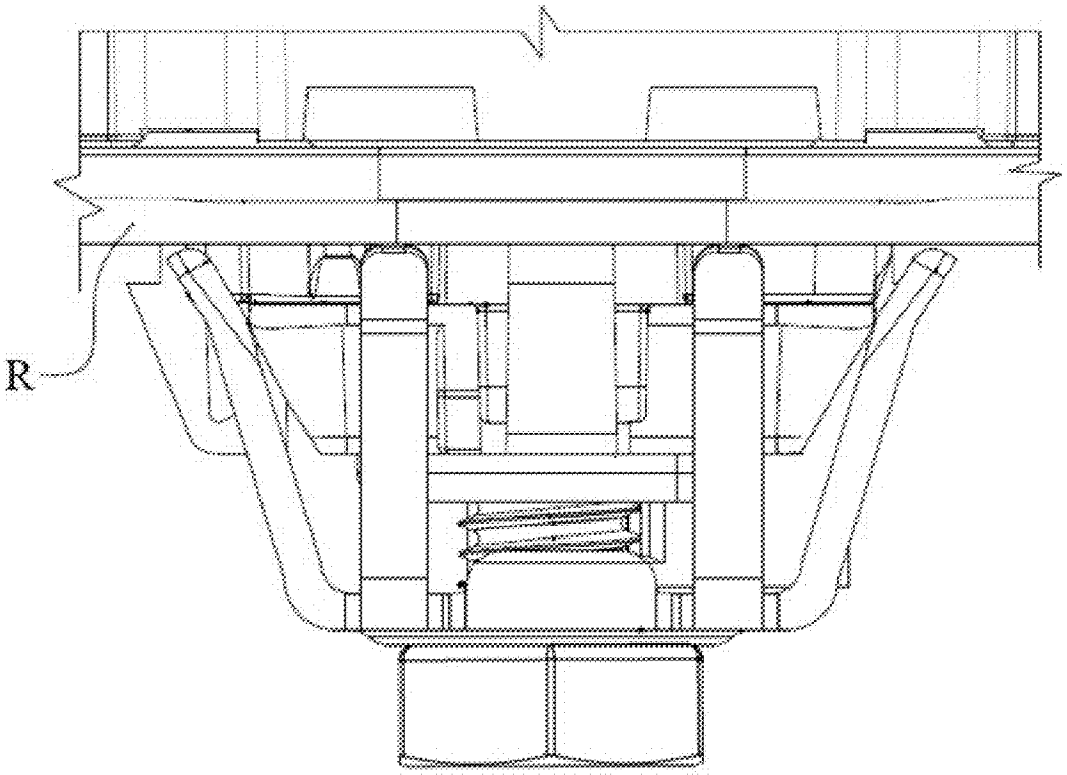
Figure 8D:
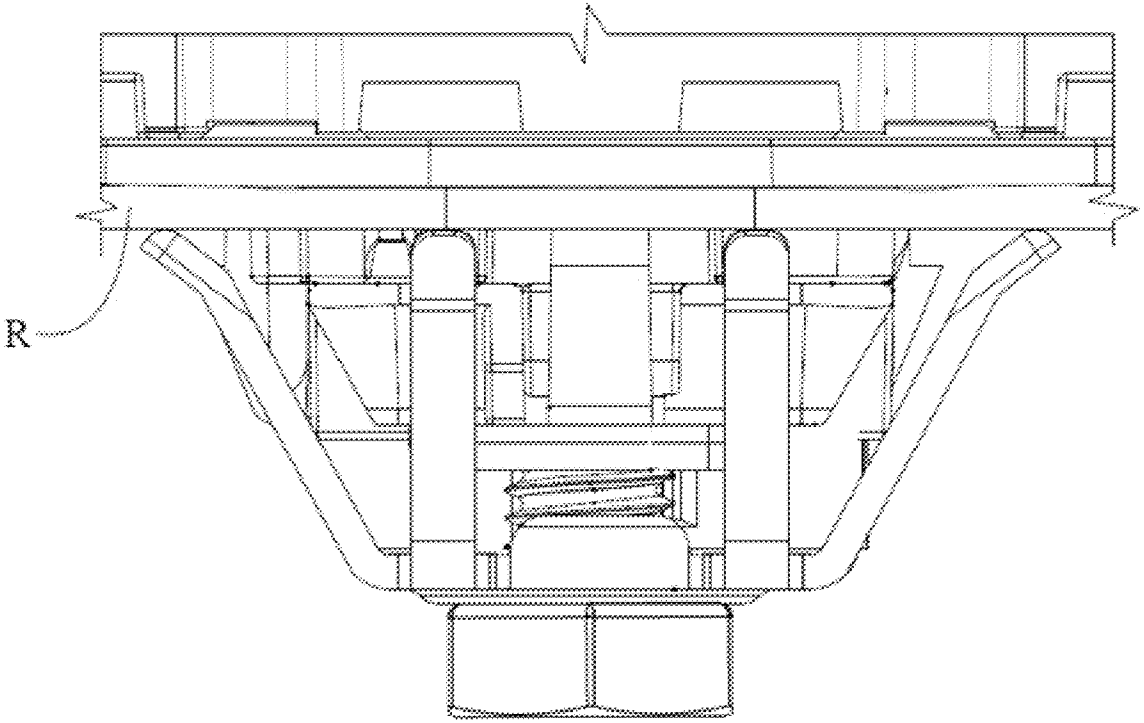

In this stage of the installation process shown in FIG. 8A, the antenna assembly 100 is temporarily held in place by virtue of the interaction of the shoulder portions 133 of the clips 132, vehicle roof R, and antenna base 108. The shoulder portions 133 of the clips 132 are disposed under the interior surface of the vehicle roof R, while the antenna base 108 is disposed on the exterior side of the vehicle roof R. Also in this stage of the installation process, the portion 121 of the dust seal 113 abuts the roof R, and the latching member's latching surface 169 is engaged with the snap clip's abutment surface 158. The back tension or spring force exerted by the snap clip members 150 firmly holds the cosmetic cover 106 and the antenna base 108 together. The back tension or spring force exerted by the snap clip members 150 may reduce vibration and/or rattling of the outer cover 106.

The installer may now enter the vehicle to access the head of the bolt 130 using a socket wrench or other suitable tool to grip the head of the bolt 130 to rotate it and tighten it. FIGS. 8A through 8D show progression of this tightening process. As the bolt 130 rotates, it threads into the corresponding threaded portion associated with the antenna base mounting structure. Alternative embodiments may include other suitable driving elements, fasteners, bolts having differently-shaped or non-hexagonal heads, etc. The rotating bolt 130 pulls the first and second retaining components 126, 128 upward toward the interior surface of the vehicle roof R while at about the same time pulls the antenna base 108 downward toward the exterior surface of the vehicle roof R. The cam surfaces of the second retaining component 128 are configured to deform and expand the retaining legs 134 of the first retaining component 126 generally outward as the bolt 130 pulls the first retaining component 126 upward. Continued movement of the bolt 130 pulls the end portions 144 of the legs 134 into contact with the interior side of the vehicle roof R. This contact may also help facilitate or cause the legs 134 (or at least the outwardly bent end portions 144 thereof) to deform and expand generally outward. This outward deformation and flexing of the retaining legs 134 provides a relatively secure engagement between the end portions 144 of the legs 134 and the interior of the roof R. The continued bolt movement also pulls the antenna base 108 downward into contact with the exterior surface of the vehicle roof R. Standoffs of the antenna base 108 engage the roof R and, together with the retaining legs 134, securely hold the antenna assembly 100 against the roof R on the vehicle. The overlap between the lower surface of the base 108 and the lower edge of the cosmetic cover 106 is now about zero millimeters.

As can be seen in FIGS. 1 and 3, a seal 182 (e.g., O-ring, resiliently compressible elastomeric or foam gasket, etc.) is provided for substantially sealing the underside of the antenna base 108 and the external side of the vehicle roof R. The seal 182 is generally annular and may be seated within a groove. Preferably, the seal 182 prevents (or at least inhibits) the ingress or penetration of water, moisture, dust, or other contaminants through the mounting opening into the interior of the vehicle after the antenna assembly 100 is finally installed to the vehicle. In some embodiments, the seal 182 is formed from a sufficiently resilient material (e.g., elastomeric or foam material, etc.) that allows the seal to be compressively seated at least partially within the groove such that the seal 182 will not drop or fall out as the antenna assembly 100 is being mounted to the vehicle roof R. Alternatively, or additionally, sealing may be achieved by one or more sealing features integrally formed or defined by the antenna base 108. As another example, a sealing member 127 (FIG. 6) may also be provided generally between the antenna base 108 and the protective cover 112. Alternatively, or additionally, sealing may be achieved by one or more sealing features integrally formed or defined by the antenna base 108.

In the exemplary installation process just described, the cosmetic cover 106 was initially engaged to the antenna base module 104 before nipping (from inside the vehicle) and securely attaching the antenna base module 104 to the vehicle roof R. In that exemplary process, the nipping of the antenna assembly 100 to the vehicle roof R by driving the fastener member 130 also caused the portion 121 of the dust seal 113 to abut and apply pressure against the vehicle roof R. This installation process is only one of many possible ways for which a cover of the present disclosure may be used and installed to a vehicle. For example, other embodiments include the antenna base module being nipped and securely attached to a vehicle roof R before positioning the outer cosmetic cover over the antenna base module. In this alternative installation process, downward pressure may be applied to the outer cosmetic cover (e.g., by an installer manually pushing downward on the cover, etc.) for causing the snap clip members to contact the latching members and move the snap clip members along the latching members thereby allowing the snap clip members to be moved past the latching members ("over travel" distance). The downward pressure will also cause the portion of the dust seal (or bottom edge of the outer cosmetic cover if there is no dust seal) to abut and apply pressure against the vehicle roof R. In response to the cessation of downward pressure applied to the cover, the snap clip members may be resiliently bent, flexed, deformed, or otherwise moved relative to the cosmetic cover, such that the snap clip members springing back toward their original positions may exert back tension for creating the substantially zero-gap fit of the outer cosmetic cover to the vehicle roof R.

The back tension described with respect to the curved snap clip members 150 of the cosmetic cover 106, as well as their resilient (or compliant) nature allow the cosmetic cover 106 to adjustably move upward or downward away from or toward the protective cover 112 and vehicle roof R (or other body wall of the vehicle) as necessary to achieve a substantially zero-gap fit such that there is little to no space between the portion 121 of the dust seal 113 and the vehicle roof R. The back tension then holds the outer cover 106 and/or the inner cover 112 firmly in place to maintain the substantially zero-gap fit. For example, even when the antenna components are not precisely manufactured due to tolerances and variances, the ability of the outer cosmetic cover 106 to float or shift or adjust upwardly or downwardly to accommodate for the tolerances while being held firmly in place due to the described back tension of the latching mechanism will still allow for substantially zero-gap with a relatively perfect fit between the portion 121 of the dust seal 113 and the vehicle roof R or with a relatively perfect fit between the bottom edge of the outer cover 106 and the vehicle roof R if there is no dust seal 113. Moreover, when antenna base modules 104 are installed on different vehicles having different vehicle body wall shapes such that differently shaped cosmetic covers are intended to be used, the unique back tension-based interconnection described herein between the snap clip members 150 of the cosmetic cover 106 and the latching member 162 of the antenna base module 104 (or vice versa) allow for substantially zero-gap fit even when different cosmetic covers are used with common or identical base modules.

In some aspects, the above described exemplary installation process may include repeating the process for additional antenna assemblies. For example, the process may include installing a first antenna assembly to a first vehicle. The first antenna assembly may include a first antenna base module and a first cosmetic cover sized and shaped to conform to the shape of the vehicle wall surface of the first vehicle. The process may then include installing a second antenna assembly to a second vehicle different from the first vehicle. The second antenna assembly may include an antenna base module having the same or common design as the antenna base module of the first antenna assembly. But the second antenna assembly may have a different cosmetic cover that is tailored or configured (e.g., sized, shaped, colored, etc.) so as to conform to the different features (e.g., contour, curvature, color, etc.) of the second vehicle wall surface. The process may further include installing additional antenna assemblies having common antenna base modules but different cosmetic covers to additional vehicles, which may have differently shaped, curved, contoured, etc., vehicle wall surfaces.

In the above-described examples, the snap clip members 150 are configured to resiliently bend, flex, deform, or otherwise move. In some exemplary embodiments, the latching members 162 are configured such that they won't deform. In such exemplary embodiments, the snap clip members 150 may resiliently bend, flex, deform, or otherwise move without any bending, flexing, or deforming of the latching members 162. In other exemplary embodiments, the snap clip members 150 and latching members 162 may both be configured to allow them to resiliently bend, flex, deform, or otherwise move. In yet other exemplary embodiments, the latching members 162 may be configured to resiliently bend, flex, deform, or otherwise move without any bending, flexing, or deforming of the snap clip members. The cosmetic cover or the antenna base may include latching members or snap clip members such that back tension is provided in a parallel direction to the latching members and/or snap clip members. Back tension between the snap clip members and latching members may be operable for limiting upward vertical motion of the cover away from the antenna base to help the antenna assembly withstand external forces applied to the latch members.

Some alternative embodiments of the antenna assembly may include only an outer cover without any inner protective environmental cover. In these alternative embodiments, the outer cover may not only provide an aesthetically pleasing appearance to the antenna assembly with a substantially zero-gap fit between the antenna assembly and the vehicle body wall, but the outer cover may also function as a protective cover. For example, the outer cover may be configured to secure to the antenna base and help with sealing of the interior enclosure of the antenna base module to inhibit the ingress of contaminants into the interior enclosure in which at least one antenna element may be disposed. The outer cover may also be configured such that its bottom edge directly contacts and conforms against the vehicle body wall without any gap or with substantially zero gap therebetween in the final installed position of the antenna assembly to the vehicle body wall.

In some of these alternative embodiments that do not include an inner protective environmental cover, the antenna assembly may include at least one sealing member disposed between the outer cover and the vehicle body wall for sealing the interface therebetween. This sealing member may comprise a discrete component (e.g., an elastomeric dust seal, a thermoplastic elastomer dust seal, a rubber dust seal, etc.) separate from the outer cover, or it may be integral to the outer cover. In such exemplary embodiments, a portion of the sealing member may be disposed along a bottom edge of the outer cover. In the final installed position of the antenna assembly to the vehicle body wall, a substantially zero-gap may be achieved between the bottom edge of the outer cover and the portion of the sealing member and between the vehicle body wall and the portion of the sealing member. The portion of the sealing member may also be compressed between the bottom edge of the outer cover and the vehicle body wall.

In some exemplary embodiments, an electrical connector may extend outward from an underside of the antenna base for coupling the antenna assembly to a suitable communication link. In some embodiments, the electrical connector may be an ISO (International Standards Organization) standard electrical connector or a Fakra connector attached to the antenna base. Accordingly, a coaxial cable (or other suitable communication link) may be relatively easily connected to the electrical connector and used for communicating signals received by the antenna assembly to another device, such as a radio receiver, display screen, or other suitable device. In such embodiments, the use of standard ISO electrical connectors or Fakra connectors may allow for reduced costs as compared to those antenna installations that require a customized design and tooling for the electrical connection between the antenna assembly and cable. In addition, the pluggable electrical connections between the communication link and the antenna assembly's electrical connector may be accomplished by the installer without the installer having to complexly route wiring or cabling through the vehicle body wall. Accordingly, the pluggable electrical connection may be easily accomplished without requiring any particular technical and/or skilled operations on the part of the installer. Alternative embodiments, however, may include using other types of electrical connectors and communication links (e.g., pig tail connections, etc.) besides standard ISO electrical connectors, Fakra connectors, and coaxial cables.

Embodiments and aspects of the present disclosure may be used in a wide range of antenna applications, such as patch antennas, telematics antennas, antennas configured for receiving satellite signals (e.g., Satellite Digital Audio Radio Services (SDARS), Global Positioning System (GPS), cellular signals, etc.), antennas configured for receiving RF energy or radio transmissions (e.g., AM/FM radio signals, etc.), combinations thereof, among other applications in which wireless signals are communicated between antennas. Accordingly, the scope of the present disclosure should not be limited to only one specific form/type of antenna assembly.

In addition, various antenna assemblies and components disclosed herein can be mounted to a wide range of supporting structures, including stationary platforms and mobile platforms. For example, an antenna assembly disclosed herein could be mounted to a supporting structure of a bus, train, aircraft, among other mobile platforms. Accordingly, the specific references to automobiles or vehicles herein should not be construed as limiting the scope of the present disclosure to any specific type of supporting structure or environment.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "includes", "including," "has", "have", and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An antenna assembly for installation to a vehicle body wall, the antenna assembly comprising:

an antenna base module mountable to the vehicle body wall and including one or more latching members;

an outer cover having one or more snap clip members engageable with the one or more latching members when the outer cover is positioned generally over the antenna base module to connect the outer cover to the antenna base module, each of the snap clip members including a curved portion and a flex point; and the snap clip members and the latching members are configured such that the snap clip members flex at their respective flex points and exert back tension on the latching members when the snap clip members engage the latching members, whereby the curved portions and the flex points of the snap clip members cause the snap clip members to rotate or travel in an arc when the snap clip members flex at their respective flex points to thereby provide the back tension on the latching members.

2. The antenna assembly of claim 1, wherein the antenna assembly includes a portion that conforms against the vehicle body wall substantially without any gap therebetween in a final installed position of the antenna assembly to the vehicle body wall.

3. The antenna assembly of claim 1, further comprising a dust seal that includes a portion compressed between a bottom edge of the outer cover and the vehicle body wall, and wherein the portion of the dust seal conforms against the vehicle body wall substantially without any gap between the portion of the dust seal and the vehicle body wall in a final installed position of the antenna assembly to the vehicle body wall.

4. The antenna assembly of claim 1, wherein the outer cover includes a bottom edge that conforms against the vehicle body wall substantially without any gap between the vehicle body wall and the bottom edge of the outer cover in a final installed position of the antenna assembly to the vehicle body wall.

5. The antenna assembly of claim 1, wherein the snap clip members exert back tension in a substantially opposing direction relative to the latching members when the snap clip members and the latching members are engaged, and wherein the curved portions of the snap clip members comprise S-shape curved portions.

6. The antenna assembly of claim 1, wherein the antenna base module includes a base, an inner cover coupled to the base, and at least one antenna element disposed within an interior enclosure collectively defined by the inner cover and the base, and wherein the curved portion of each snap clip member includes or is at the flex point such that a curve is at a point of flex of the snap clip member for causing the snap clip member to rotate or travel in an arc in a first direction away from the latching member when the snap clip member is being slidably engaged along the latching member and to rotate or travel in an arc in a second direction, opposite the first direction, toward the latching member after an end portion the snap clip member has cleared the latching member.

7. The antenna assembly of claim 6, wherein:

the latching members are integrally defined by the inner cover;

the snap clip members are integrally defined by the outer cover;

the one or more snap clip members include a snap clip member located adjacent a front of the outer cover and two snap clip members located along opposing sides of the outer cover adjacent a back of the outer cover; and the one or more latching members include a latching clip member located adjacent a front of the inner cover and two latching members located along opposing sides of the inner cover adjacent a back of the inner cover.

8. The antenna assembly of claim 1, wherein:

each of the snap clip members includes an abutment surface and a cam surface; and the cam surface is configured to contact a corresponding portion of the latching member for urging the snap clip member in a first rotational direction such that the abutment surface of the snap clip member rotates away from a corresponding latching surface of the latching member when the outer cover is being positioned generally over the antenna base module to thereby allow the abutment surface of the snap clip member to be positioned generally under the corresponding latching surface of the latching member; whereby after the abutment surface of the snap clip member clears the latching member, the snap clip member rotates in a second rotational direction opposite the first rotational direction such that the abutment surface of the snap clip member rotates toward and into engagement with the corresponding latching surface of the latching member.

9. The antenna assembly of claim 1, wherein an end portion of the snap clip member rotates in a first rotational direction when the snap clip member is being engaged with the latching member, and wherein the end portion of the snap clip member rotates in a second rotational direction that is opposite the first rotational direction and that includes upward travel after the end portion of the snap clip member clears the latching member, which upward travel pulls the outer cover downward towards the antenna base module.

10. The antenna assembly of claim 1, wherein the snap clip members rotate or travel in an arc in a first direction when the snap clip members flex at their respective flex points when the snap clip members are being engaged with the latching members, and in a second direction opposite the first direction after end portions of the snap clip members clear the latching members.

11. An antenna assembly for installation to a vehicle body wall, the antenna assembly comprising:

an antenna base module mountable to the vehicle body wall and including at least one latching member;

an antenna cover having at least one snap clip member engageable with the latching member when the antenna cover is positioned generally over the antenna base module to connect the antenna cover to the antenna base module, the at least one snap clip member including a curved portion and a flex point;

the snap clip member and the latching member being configured such that, when engaged, the snap clip member flexes at the flex point to exert back tension against the latching member;

whereby the curved portion and the flex point of the snap clip member cause the snap clip member to rotate or travel in an arc when the snap clip member flexes at the flex point to thereby provide the back tension against the latching member; and whereby, in a final installed position of the antenna assembly to the vehicle body wall, a portion of the antenna assembly conforms against the vehicle body wall substantially without any gap therebetween.

12. The antenna assembly of claim 11, further comprising a dust seal that includes the portion of the antenna assembly that conforms against the vehicle body wall substantially without any gap therebetween in the final installed position of the antenna assembly to the vehicle body wall.

13. The antenna assembly of claim 11 wherein a bottom edge of the antenna cover includes the portion of the antenna assembly that conforms against the vehicle body wall substantially without any gap therebetween in the final installed position of the antenna assembly to the vehicle body wall.

14. The antenna assembly of claim 11, wherein the snap clip member exerts back tension in a substantially opposing direction relative to the latching member when the snap clip member and the latching member are engaged, and wherein the curved portion of the snap clip member comprises an S-shape curved portion.

15. The antenna assembly of claim 11, wherein the antenna base module comprises a base, an inner cover coupled to the base, and at least one antenna element disposed within an interior enclosure collectively defined by the inner cover and the base, the antenna cover receiving at least a portion of the inner cover and base therein after connecting the antenna cover to the antenna base module; and wherein the curved portion of the snap clip member includes or is at the flex point such that a curve is at a point of flex of the snap clip member for causing the snap clip member to rotate or travel in an arc in a first direction away from the latching member when the snap clip member is being slidably engaged along the latching member and to rotate or travel in an arc in a second direction, opposite the first direction, toward the latching member after an end portion the snap clip member has cleared the latching member.

16. The antenna assembly of claim 15, wherein:

the latching member is integrally defined by the inner cover;

the snap clip member is integrally defined by the antenna cover;

the one or more snap clip members include a snap clip member located adjacent a front of the antenna cover and two snap clip members located along opposing sides of the antenna cover adjacent a back of the antenna cover; and the one or more latching members include a latching clip member located adjacent a front of the inner cover and two latching members located along opposing sides of the inner cover adjacent a back of the inner cover.

17. The antenna assembly of claim 11, wherein:

the snap clip member includes an abutment surface and a cam surface; and the cam surface is configured to contact a corresponding portion of the latching member for urging the snap clip member in a first rotational direction such that the abutment surface of the snap clip member rotates away from a corresponding latching surface of the latching member when the antenna cover is being positioned generally over the antenna base module to thereby allow the abutment surface of the snap clip member to be positioned generally under the corresponding latching surface of the latching member;

whereby after the abutment surface of the snap clip member clears the latching member, the snap clip member rotates in a second rotational direction opposite the first rotational direction such that the abutment surface of the snap clip member rotates towards and into engagement with the corresponding latching surface of the latching member.

18. The antenna assembly of claim 11, wherein an end portion of the snap clip member rotates in a first rotational direction when the snap clip member is being engaged with the latching member, and wherein the end portion of the snap clip member rotates in a second rotational direction that is opposite the first rotational direction and that includes upward travel after the end portion of the snap clip member clears the latching member, which upward travel pulls the antenna cover downward towards the antenna base module.

19. The antenna assembly of claim 11, wherein the snap clip member rotates or travels in an arc in first direction when the snap clip member flexes at the flex point when the snap clip member is being engaged with the latching member, and in a second direction opposite the first direction after an end portion of the snap clip member clears the latching member.

20. A method relating to installation of an antenna assembly to a vehicle body wall, the method comprising connecting an antenna cover to an antenna base module by moving an end portion of at least one snap clip member of the antenna cover along a corresponding portion of at least one latching member of the antenna base module so that the end portion of the at least one snap clip member moves past a latching surface of the at least one latching member, the at least one snap clip member including a curved portion and a flex point, whereby in a final installed position, the at least one snap clip member flexes at the flex point which positions the end portion of the at least one snap clip member underneath the latching surface and exerts back tension on the at least one latching member, such that a portion of the antenna assembly conforms against the vehicle body wall substantially without any gap therebetween, and whereby the curved portion and the flex point of the snap clip member cause the snap clip member to rotate or travel in an arc when the snap clip member flexes at the flex point to thereby provide the back tension on the latching member.

* * * * *